US011640783B2

(12) United States Patent
Pyun et al.

(10) Patent No.: US 11,640,783 B2
(45) Date of Patent: May 2, 2023

(54) DRIVING CONTROLLER, DISPLAY APPARATUS INCLUDING THE SAME AND METHOD OF DRIVING DISPLAY PANEL USING THE SAME

(71) Applicant: Samsung Display Co., Ltd., Yongin-Si (KR)

(72) Inventors: Kihyun Pyun, Gwangmyeong-si (KR); Wonjin Seo, Seoul (KR); Eunjin Choi, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/501,998

(22) Filed: Oct. 14, 2021

(65) Prior Publication Data

US 2022/0044617 A1 Feb. 10, 2022

Related U.S. Application Data

(63) Continuation of application No. 17/149,610, filed on Jan. 14, 2021, now Pat. No. 11,170,691.

(30) Foreign Application Priority Data

Apr. 13, 2020 (KR) ..... 10-2020-0044512

(51) Int. Cl.
*G09G 3/20* (2006.01)

(52) U.S. Cl.
CPC ... *G09G 3/2007* (2013.01); *G09G 2310/0275* (2013.01); *G09G 2320/0626* (2013.01)

(58) Field of Classification Search
None
See application file for complete search history.

(56) References Cited

U.S. PATENT DOCUMENTS

2005/0007392 A1 1/2005 Kasai et al.
2008/0094388 A1* 4/2008 Yamazaki ..... G09G 3/3655 345/212
2014/0347339 A1* 11/2014 Han ..... G09G 3/3233 345/212
2015/0262532 A1 9/2015 Lim et al.
(Continued)

FOREIGN PATENT DOCUMENTS

KR 10-0757567 B1 9/2007
KR 10-2016-0028591 A 3/2016
(Continued)

*Primary Examiner* — Matthew Yeung
(74) *Attorney, Agent, or Firm* — Innovation Counsel LLP

(57) ABSTRACT

A driving controller set includes a net power control setter, a data clamper, a data line, and a data driver. The net power control setter may determine a first scale factor for adjusting a grayscale value of (N+1)-th frame data based on a load of N-th frame data and a net power control reference value. N is an integer equal to or greater than two. The data clamper may determine a second scale factor for adjusting a grayscale value of the N-th frame data based on a load of (N−1)-th frame data and the N-th frame data. A data signal may be generated using the first scale factor and/or the second scale factor. The data line may include a conductive material. The data driver may convert the data signal into a data voltage and may output the data voltage to the data line.

20 Claims, 11 Drawing Sheets

(56) References Cited

U.S. PATENT DOCUMENTS

| | | | | |
|---|---|---|---|---|
| 2016/0125786 | A1* | 5/2016 | Lai | G09G 3/2018 345/691 |
| 2016/0155382 | A1* | 6/2016 | Cheon | G09G 3/3258 345/76 |
| 2016/0155388 | A1 | 6/2016 | Baik | |
| 2020/0045206 | A1 | 2/2020 | Yim et al. | |
| 2021/0193058 | A1 | 6/2021 | Lee et al. | |

FOREIGN PATENT DOCUMENTS

| | | | |
|---|---|---|---|
| KR | 10-2016-0074853 | A | 6/2016 |
| KR | 10-1652785 | B1 | 9/2016 |

* cited by examiner

DRIVING CONTROLLER, DISPLAY APPARATUS INCLUDING THE SAME AND METHOD OF DRIVING DISPLAY PANEL USING THE SAME

CROSS-REFERENCE TO RELATED APPLICATION(S)

This application is a continuation application of U.S. patent application Ser. No. 17/149,610 filed on Jan. 14, 2021, which claims priority under 35 U.S.C. § 119 to Korean Patent Application No. 10-2020-0044512, filed on Apr. 13, 2020 in the Korean Intellectual Property Office; the Korean Patent Application is incorporated by reference.

BACKGROUND

1. Field

The technical field relates to a driving controller, a display apparatus including the driving controller and a method of driving a display panel using the driving controller.

2. Description of the Related Art

Generally, a display apparatus includes a display panel and a display panel driver. The display panel displays an image based on input image data. The display panel includes a plurality of gate lines, a plurality of data lines and a plurality of pixels. The display panel driver includes a gate driver, a data driver and a driving controller. The gate driver outputs gate signals to the gate lines. The data driver outputs data voltages to the data lines. The driving controller controls the gate driver and the data driver.

If luminance of the display panel is not adjusted according to a load of the input image data, the data driver or the display panel may be damaged due to an overcurrent flowing through the data driver or the display panel.

A delay of one frame may occur for determining the load of the input image data. When input image data which does not require a luminance adjustment is input in an (N−1)-th frame and input image data which requires the luminance adjustment is input in an N-th frame, the luminance adjustment may not immediately operate in the N-th frame due to the delay of one frame. When the luminance adjustment may not immediately operate in the N-th frame, the overcurrent may flow through the data driver or the display panel during the N-th frame so that the data driver or the display panel may be damaged.

SUMMARY

Example embodiments may be related to a driving controller adjusting luminance of a display panel according to a load of input image data to prevent a damage of a data driver or the display panel.

Example embodiments may be related to a display apparatus including the driving controller.

Example embodiments may be related to a method of driving a display panel using the driving controller.

In an example embodiment of a driving controller according to the present inventive concept, the driving controller includes a net power control setter and a data clamper. The net power control setter is configured to determine a first scale factor for adjusting a grayscale value of (N+1)-th frame data based on a load of N-th frame data and a net power control reference value. The data clamper is configured to determine a second scale factor for adjusting a grayscale value of the N-th frame data based on a load of (N−1)-th frame data and the N-th frame data. N is an integer equal to or greater than two.

In an example embodiment, the data clamper may be activated when the (N−1)-th frame data is different from the N-th frame data. The data clamper may be deactivated when the (N−1)-th frame data is same as the N-th frame data.

In an example embodiment, the data clamper may be configured to receive the load of the (N−1)-th frame data, a net power control signal of an (N−1)-th frame and the N-th frame data.

In an example embodiment, when the net power control signal of the (N−1)-th frame is inactive, the second scale factor may gradually decrease as the load of the (N−1)-th frame data increases from 0% to the net power control reference value.

In an example embodiment, when the net power control signal of the (N−1)-th frame is active, the second scale factor may gradually decrease as the load of the (N−1)-th frame data increases from the net power control reference value to 100%.

In an example embodiment, when the net power control signal of the (N−1)-th frame is inactive, the second scale factor may be fixed regardless of the load of the (N−1)-th frame data.

In an example embodiment, when the net power control signal of the (N−1)-th frame is active, the second scale factor may be fixed regardless of the load of the (N−1)-th frame data.

In an example embodiment, the driving controller may further include a load sum calculator configured to receive the N-th frame data and calculate a sum of total grayscale values of the N-th frame data.

In an example embodiment, the driving controller may further include a load calculator configured to receive the sum of the total grayscale values of the N-th frame data and calculate the load of the N-th frame data.

In an example embodiment, the data clamper may be configured to receive the load of the N-th frame data from the load calculator.

In an example embodiment, a final scale factor of the (N+1)-th frame data may be determined by multiplying the first scale factor and the second scale factor.

In an example embodiment of a display apparatus according to the present inventive concept, the display apparatus includes a display panel, a driving controller and a data driver. The display panel is configured to display an image based on input image data. The driving controller includes a net power control setter configured to determine a first scale factor for adjusting a grayscale value of (N+1)-th frame data based on a load of N-th frame data and a net power control reference value and a data clamper configured to determine a second scale factor for adjusting a grayscale value of the N-th frame data based on a load of (N−1)-th frame data and the N-th frame data. The driving controller is configured to generate a data signal based on the input image data. The data driver is configured to convert the data signal into a data voltage and output the data voltage to the display panel. N is an integer equal to or greater than two.

In an example embodiment, the data clamper may be activated when the (N−1)-th frame data is different from the N-th frame data. The data clamper may be deactivated when the (N−1)-th frame data is same as the N-th frame data.

In an example embodiment, the data clamper may be configured to receive the load of the (N−1)-th frame data, a net power control signal of an (N−1)-th frame and the N-th frame data.

In an example embodiment, the driving controller may further include a load sum calculator configured to receive the N-th frame data and calculate a sum of total grayscale values of the N-th frame data.

In an example embodiment, the driving controller may further include a load calculator configured to receive the sum of the total grayscale values of the N-th frame data and calculate the load of the N-th frame data.

In an example embodiment, the data clamper may be configured to receive the load of the N-th frame data from the load calculator.

In an example embodiment of a method of driving a display panel according to the present inventive concept, the method includes determining a first scale factor for adjusting a grayscale value of (N+1)-th frame data based on a load of N-th frame data and a net power control reference value, determining a second scale factor for adjusting a grayscale value of the N-th frame data based on a load of (N−1)-th frame data and the N-th frame data, compensating input image data based on the first scale factor and the second scale factor, generating a data signal based on the compensated input image data and converting the data signal into a data voltage and outputting the data voltage to the display panel. N is an integer equal to or greater than two.

In an example embodiment, the second scale factor may be generated when the (N−1)-th frame data is different from the N-th frame data. The second scale factor may not be generated when the (N−1)-th frame data is same as the N-th frame data.

In an example embodiment, the method may further include determining a final scale factor of the (N+1)-th frame data by multiplying the first scale factor and the second scale factor.

An embodiment may be related to a driving controller set. The driving controller may include a net power control setter, a data clamper, a data line, and a data driver. The net power control setter may determine a first scale factor for adjusting a grayscale value of (N+1)-th frame data based on a load of N-th frame data and a net power control reference value. N is an integer equal to or greater than two. The data clamper may determine a second scale factor for adjusting a grayscale value of the N-th frame data based on a load of (N−1)-th frame data and the N-th frame data. A data signal may be generated using at least one of the first scale factor and the second scale factor. The data line may be formed of at least one conductive material. The data driver may be electrically connected to each of the net power control setter, the data clamper, and the data line, may convert the data signal into a data voltage, and may output the data voltage to the data line.

The data clamper may be activated when the (N−1)-th frame data is different from the N-th frame data. The data clamper may be deactivated when the (N−1)-th frame data is same as the N-th frame data.

The data clamper may receive the load of the (N−1)-th frame data, a net power control signal of an (N−1)-th frame, and the N-th frame data.

When the net power control signal of the (N−1)-th frame is inactive, the second scale factor may gradually decrease as the load of the (N−1)-th frame data increases from 0% to the net power control reference value.

When the net power control signal of the (N−1)-th frame is active, the second scale factor may gradually decrease as the load of the (N−1)-th frame data increases from the net power control reference value to 100%.

When the net power control signal of the (N−1)-th frame may be inactive, the second scale factor may be fixed regardless of the load of the (N−1)-th frame data.

When the net power control signal of the (N−1)-th frame may be active, the second scale factor may be fixed regardless of the load of the (N−1)-th frame data.

The driving controller set may include a load sum calculator configured to receive the N-th frame data and to calculate a sum of total grayscale values of the N-th frame data.

The driving controller set may include a load calculator configured to receive the sum of the total grayscale values of the N-th frame data and to calculate the load of the N-th frame data.

The data clamper may receive the load of the N-th frame data from the load calculator.

A final scale factor of the (N+1)-th frame data may be determined by multiplying the first scale factor and the second scale factor.

An embodiment may be related to a display apparatus. The display apparatus may include the following elements: a display panel including a data line and a pixel electrically connected to the data line, wherein the data line may be formed of at least one conductive material; a driving controller including a net power control setter and a data clamper, wherein the net power control setter may determine a first scale factor for adjusting a grayscale value of (N+1)-th frame data based on a load of N-th frame data and a net power control reference value, wherein the data clamper may determine a second scale factor for adjusting a grayscale value of the N-th frame data based on a load of (N−1)-th frame data and the N-th frame data, wherein N may be an integer equal to or greater than two, and wherein driving controller may generate a data signal based on at least one of the first scale factor and the second scale factor; and a data driver electrically connected to each of the driving controller and the display panel, configured to convert the data signal into a data voltage, and configured to output the data voltage through the data line to the pixel to control luminance of the pixel.

The data clamper may be activated when the (N−1)-th frame data may be different from the N-th frame data. The data clamper may be deactivated when the (N−1)-th frame data may be same as the N-th frame data.

The data clamper may receive the load of the (N−1)-th frame data, a net power control signal of an (N−1)-th frame, and the N-th frame data.

The driving controller further comprises a load sum calculator configured to receive the N-th frame data and to calculate a sum of total grayscale values of the N-th frame data.

The driving controller may include a load calculator configured to receive the sum of the total grayscale values of the N-th frame data and to calculate the load of the N-th frame data.

The data clamper may receive the load of the N-th frame data from the load calculator.

An embodiment may be related to a method of driving a display panel. The method may include the following steps: determining a first scale factor for adjusting a grayscale value of (N+1)-th frame data based on a load of N-th frame data and a net power control reference value; determining a second scale factor for adjusting a grayscale value of the N-th frame data based on a load of (N−1)-th frame data and the N-th frame data; generating a data signal using at least one of the first scale factor and the second scale factor; converting the data signal into a data voltage; and outputting the data voltage through a data line to a pixel of the display panel to control luminance of the pixel. N may be an integer equal to or greater than two.

The second scale factor may be generated when the (N−1)-th frame data may be different from the N-th frame data. The second scale factor may not be generated when the (N−1)-th frame data is same as the N-th frame data.

The method may include determining a final scale factor of the (N+1)-th frame data by multiplying the first scale factor and the second scale factor.

According to embodiments, the luminance of a display panel may be adjusted according to the load of the input image data so that a potential overcurrent flowing through a data driver or the display panel may be prevented.

A driving controller includes a data clamper for determining a second scale factor of the N-th frame based on the load of the (N−1)-th frame data so that an overcurrent flowing through the data driver or the display panel during the N-th frame potentially caused by the delay of one frame for determining the load of the input image data and the scale factor may be prevented. Thus, damage to the data driver or the display panel may be prevented, so that the reliability of the display apparatus may be satisfactory.

DETAILED DESCRIPTION

Example embodiments are described with reference to the accompanying drawings. Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

The term "connect" may mean "electrically connect" or "electrically connected through no intervening transistor." The term "drive" may mean "operate" or "control." The term "a luminance" may mean "luminance" or "a luminance value." The term "data" used as a plural noun may represent an uncountable noun. In block diagrams, lines between blocks may represent electrical connections between elements/components.

Figure 1:
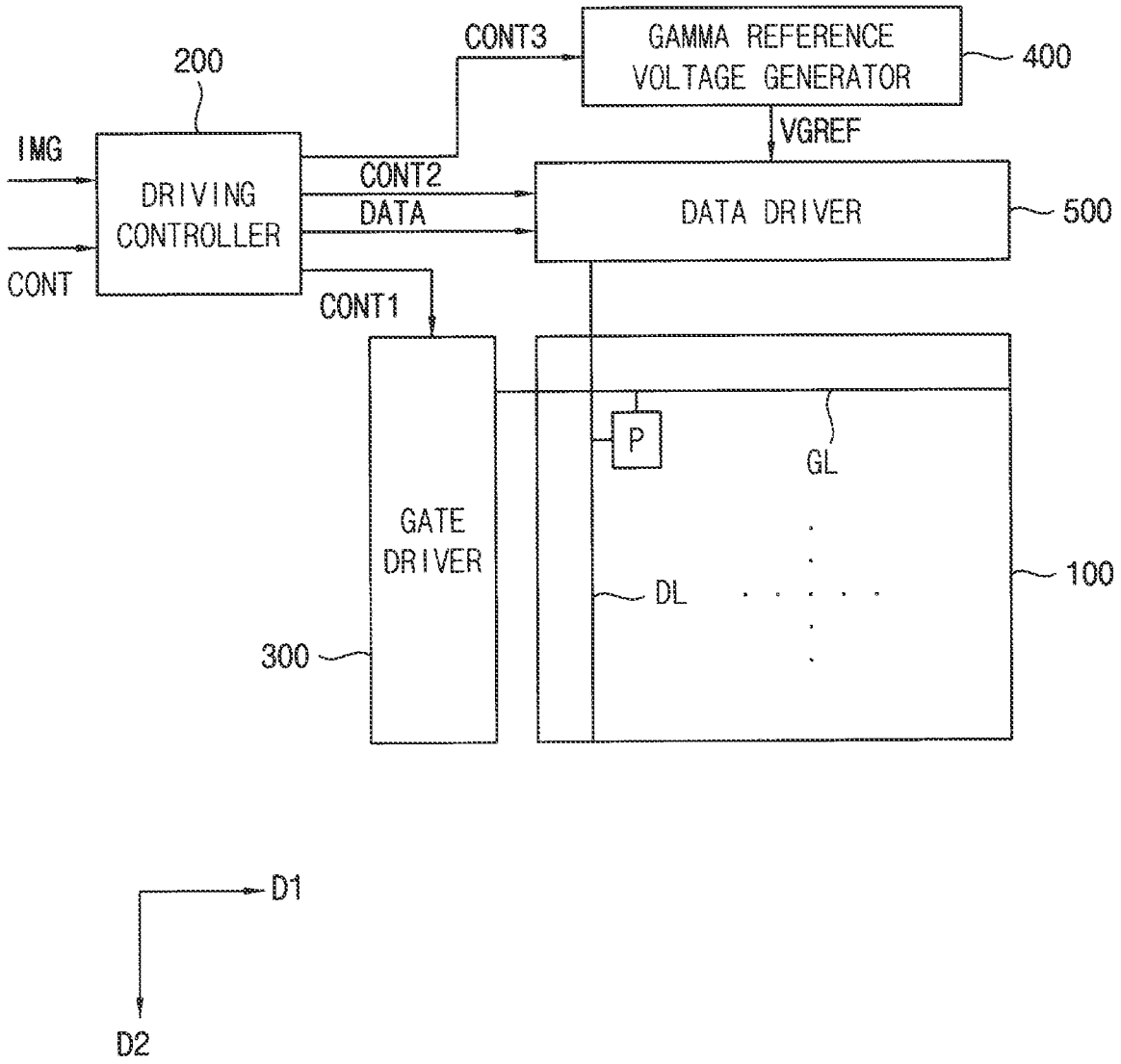
FIG. 1 is a block diagram illustrating a display apparatus according to an example embodiment.

FIG. 1 is a block diagram illustrating a display apparatus according to an example embodiment.

Referring to FIG. 1, the display apparatus includes a display panel 100 and a display panel driver. The display panel driver includes a driving controller 200, a gate driver 300, a gamma reference voltage generator 400 and a data driver 500 electrically connected to one another.

The driving controller 200 and the data driver 500 may be integrally formed. The driving controller 200, the gamma reference voltage generator 400 and the data driver 500 may be electrically connected and integrally formed. A driving module including at least the driving controller 200 and the data driver 500 which are integrally formed may be called to a timing controller embedded data driver (TED).

The display panel 100 has a display region on which an image is displayed and a peripheral region adjacent to the display region.

The display panel 100 includes a plurality of gate lines GL, a plurality of data lines DL, and a plurality of pixels P connected to the gate lines GL and the data lines DL. The gate lines GL are formed of one or more electrically conductive materials and extend in a first direction D1, and the data lines DL are formed of at least one electrically conductive material and extend in a second direction D2 different from the first direction D1.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 based on the input control signal CONT and outputs the first control signal CONT1 to the gate driver 300 for controlling an operation of the gate driver 300. The first control signal CONT1 may include a vertical start signal and a gate clock signal.

The driving controller 200 generates the second control signal CONT2 based on the input control signal CONT and outputs the second control signal CONT2 to the data driver 500 for controlling an operation of the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 based on the input control signal CONT and outputs the third control signal CONT3 to the gamma reference voltage generator 400 for controlling an operation of the gamma reference voltage generator 400.

The gate driver 300 provides gate signals to the gate lines GL in response to the first control signal CONT1 received from the driving controller 200. The gate driver 300 may sequentially output the gate signals to the gate lines GL. The gate driver 300 may be mounted on the peripheral region of the display panel 100. The gate driver 300 may be integrated in the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

The gamma reference voltage generator 400 may be disposed in the driving controller 200 or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into analog data voltages using the gamma reference voltages VGREF. The data driver 500 outputs the data voltages to the data lines DL.

Figure 2:
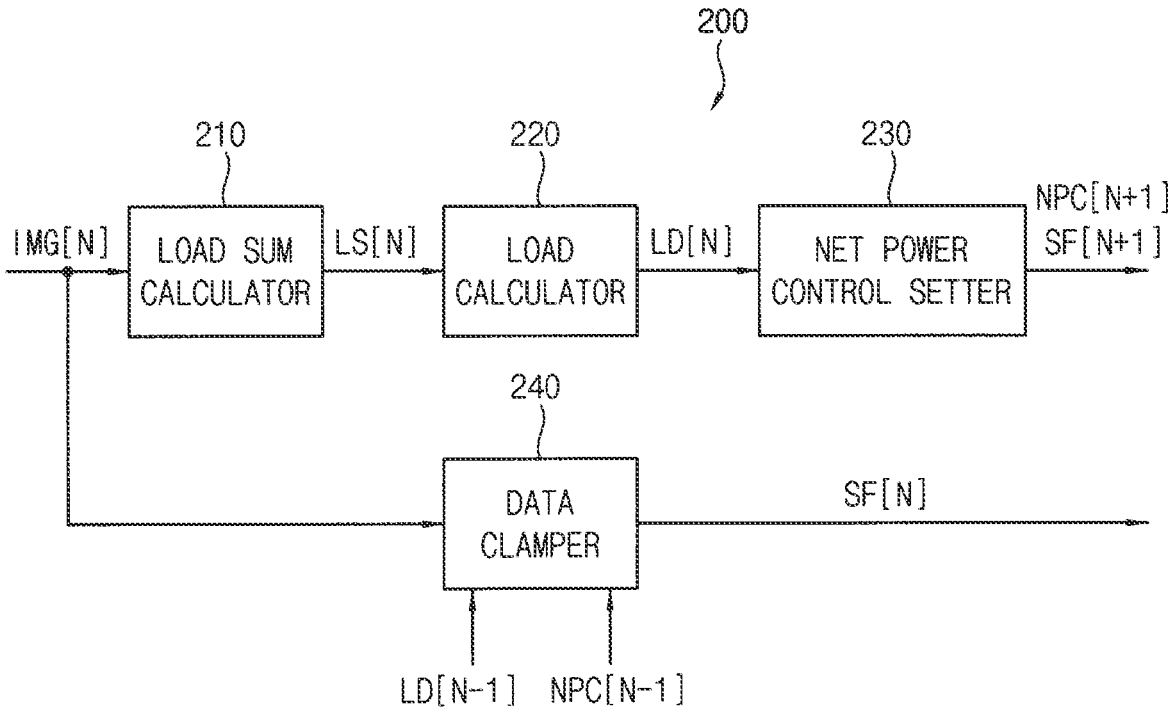
FIG. 2 is a block diagram illustrating a driving controller of FIG. 1 according to an example embodiment.

FIG. 2 is a block diagram illustrating the driving controller 200 of FIG. 1.

Referring to FIGS. 1 and 2, the driving controller 200 includes a load sum calculator 210, a load calculator 220, a net power control setter 230 and a data clamper 240.

The load sum calculator 210 may receive N-th frame data IMG[N] and calculate a sum LS[N] of total grayscale values of the N-th frame data IMG[N]. The load sum calculator 210 may divide the display panel 100 into a plurality of blocks and calculate sums of total grayscale values of respective blocks. The load sum calculator 210 may add up the sums of the total grayscale values of the respective blocks to determine the sum LS[N] of the total grayscale values of the N-th frame data IMG[N]. Herein, N is an integer equal to or greater than two.

The load calculator 220 may receive the sum LS[N] of the total grayscale values of the N-th frame data IMG[N] and calculate a load LD[N] of the N-th frame data IMG[N]. The load LD[N] may have a value between 0% and 100%. When the N-th frame data IMG[N] represent a full black image, the load LD[N] may be 0%. When the N-th frame data IMG[N] represent a full white image, the load LD[N] may be 100%.

The net power control setter 230 may determine a first scale factor SF[N+1], for adjusting a grayscale value of (N+1)-th frame data, based on the load LD[N] of the N-th frame data IMG[N] and a net power control reference value. In addition, the net power control setter 230 may generate a net power control signal NPC[N+1] representing whether a net power control function is activated for the (N+1)-th frame data or inactivated for the (N+1)-th frame. The first scale factor SF[N+1] may be equal to or less than 1 to maintain the grayscale value of the input image data or decrease the grayscale value of the input image data.

When the load LD[N] of the N-th frame data IMG[N] exceeds the net power control reference value, the net power control setter 230 may activate the net power control function.

When the load LD[N] of the N-th frame data IMG[N] exceeds the net power control reference value and the net power control function is activated, the first scale factor SF[N+1] may be less than 1. When the first scale factor SF[N+1] is 0.5, the grayscale value of the (N+1)-th frame data may be decreased to half of an input grayscale value.

Referring to FIG. 2, in order for the net power control setter 230 to determine the first scale factor SF[N+1], a delay of one frame may occur. Accordingly, the net power control setter 230 may generate the first scale factor SF[N+1] applied to the (N+1)-th frame data based on the N-th frame data IMG[N].

Due to the delay of one frame, the net power control function may not immediately operate in the N-th frame, the overcurrent may flow through the display panel 100 or the data driver 500.

The data clamper 240 may determine a second scale factor SF[N], for adjusting a grayscale value of the N-th frame data IMG[N], based on the load LD[N−1] of (N−1)-th frame data and the N-th frame data IMG[N]. The second scale factor SF[N] may be equal to or less than 1 to maintain the grayscale value of the input image data or decrease the grayscale value of the input image data.

The second scale factor SF[N] may be determined immediately with input of the N-th frame data IMG[N] without the delay of one frame.

The data clamper 240 may be activated when the (N−1)-th frame data is different from the N-th frame data IMG[N]. The data clamper 240 may be inactivated when the (N−1)-th frame data is same as the N-th frame data IMG[N].

The data clamper 240 may compare the sum of the total grayscale values of the (N−1)-th frame data and the sum of the total grayscale values of the N-th frame data to determine whether the (N−1)-th frame data is different from the N-th frame data IMG[N]. Alternatively or additionally, the data clamper 240 may compare some representative grayscale values of the (N−1)-th frame data and corresponding representative grayscale values of the N-th frame data to quickly determine whether the (N−1)-th frame data is different from the N-th frame data IMG[N].

The data clamper 240 may receive the load LD [N−1] of the (N−1)-th frame data and the net power control signal NPC [N−1] of the (N−1)-th frame and the N-th frame data.

The load LD[N−1] of the (N−1)-th frame data may be determined by the load calculator 220 in the (N−1)-th frame. The net power control signal NPC[N−1] of the (N−1)-th frame may be determined by the net power control setter 230 in the (N−1)-th frame.

Figure 3:
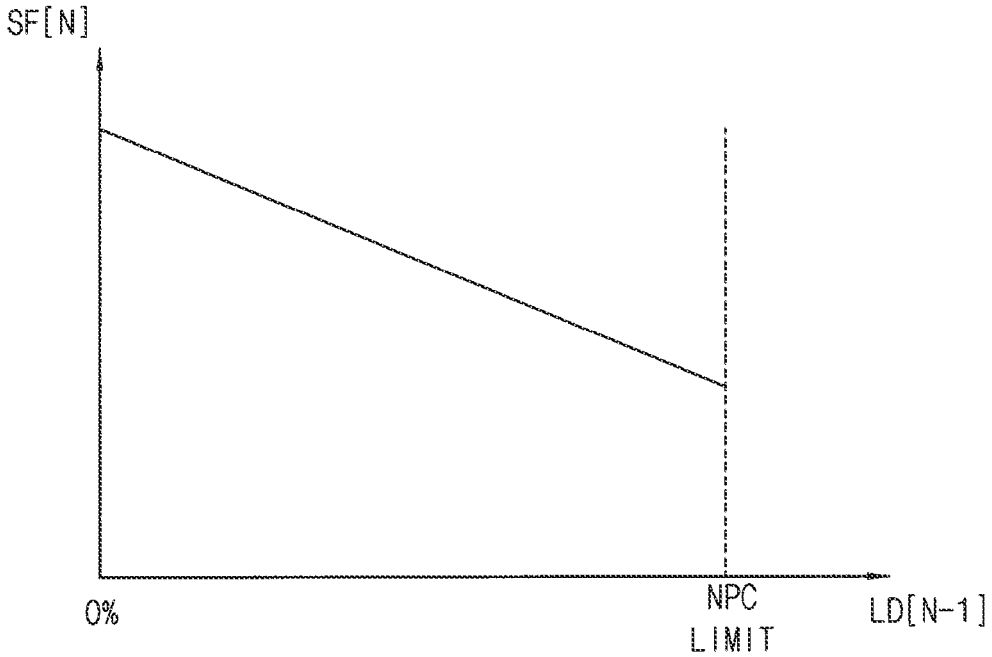
FIG. 3 is a graph illustrating an operation of a data clamper of FIG. 2 according to an example embodiment.
Figure 4:
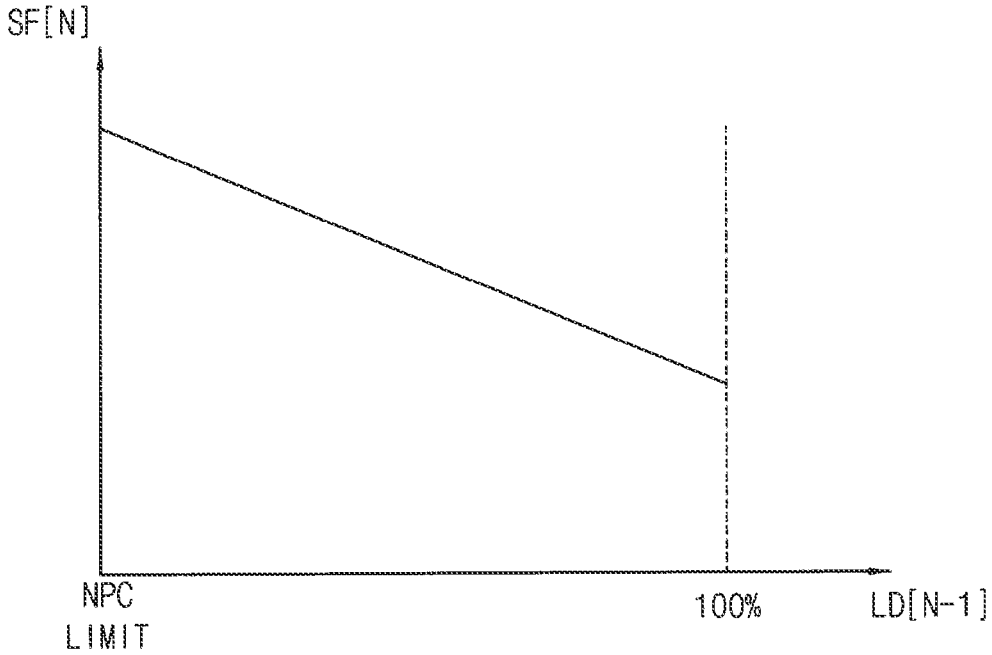
FIG. 4 is a graph illustrating an operation of the data clamper of FIG. 2 according to an example embodiment.

FIG. 3 is a graph illustrating an operation of the data clamper 240 of FIG. 2. FIG. 4 is a graph illustrating an operation of the data clamper 240 of FIG. 2.

In FIGS. 3 and 4, the second scale factor SF[N] may be varied according to the load LD[N−1] of the (N−1)-th frame. FIG. 3 represents a case that the net power control signal NPC[N−1] of the (N−1)-th frame is inactive. FIG. 4 represents a case that the net power control signal NPC[N−1] of the (N−1)-th frame is active.

Referring to FIG. 3, when the net power control signal NPC[N−1] of the (N−1)-th frame is inactive, the second scale factor SF[N] may gradually decrease as the load LD[N−1] of the (N−1)-th frame data increases from 0% to the net power control reference value NPC LIMIT.

Referring to FIG. 4, when the net power control signal NPC[N−1] of the (N−1)-th frame is active, the second scale factor SF[N] may gradually decrease as the load LD[N−1] of the (N−1)-th frame data increases from the net power control reference value NPC LIMIT to 100%.

The second scale factor SF[N] may be determined based on the load LD[N−1] of the (N−1)-th frame. The load LD[N−1] of the (N−1)-th frame and the second scale factor SF[N] may be stored in a lookup table.

Figure 5:
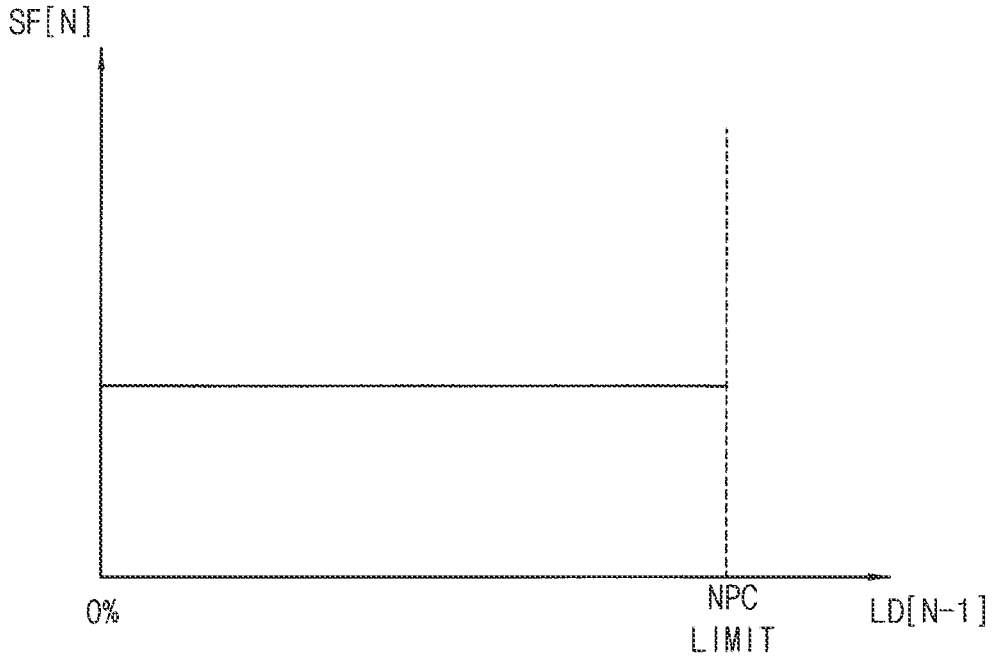
FIG. 5 is a graph illustrating an operation of the data clamper of FIG. 2 according to an example embodiment.
Figure 6:
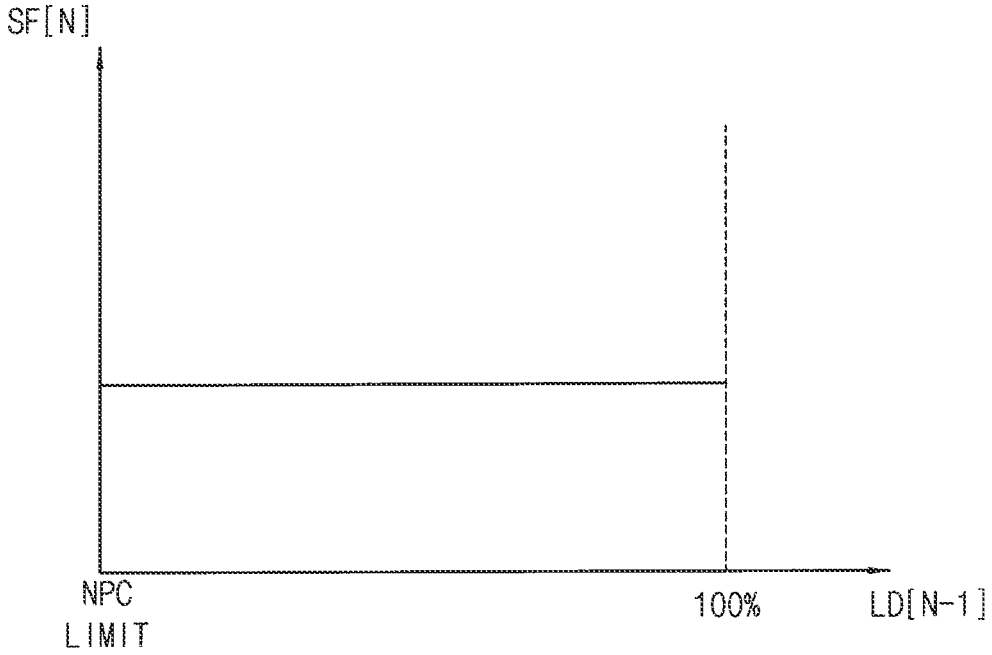
FIG. 6 is a graph illustrating an operation of the data clamper of FIG. 2 according to an example embodiment.

FIG. 5 is a graph illustrating an operation of the data clamper 240 of FIG. 2. FIG. 6 is a graph illustrating an operation of the data clamper 240 of FIG. 2.

In FIGS. 5 and 6, the second scale factor SF[N] may be fixed regardless of the load LD[N−1] of the (N−1)-th frame data. FIG. 5 represents a case that the net power control signal NPC[N−1] of the (N−1)-th frame is inactive. FIG. 6 represents a case that the net power control signal NPC[N−1] of the (N−1)-th frame is active.

Referring to FIG. 5, when the net power control signal NPC[N−1] of the (N−1)-th frame is inactive, the second scale factor SF[N] may have a fixed value regardless of the load LD[N−1] of the (N−1)-th frame data.

Referring to FIG. 6, when the net power control signal NPC[N−1] of the (N−1)-th frame is active, the second scale factor SF[N] may have a fixed value regardless of the load LD[N−1] of the (N−1)-th frame data.

Figure 7:
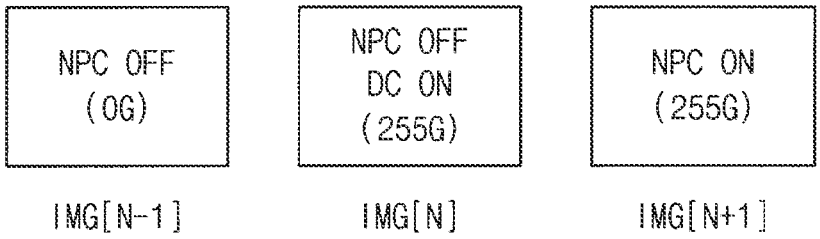
FIG. 7 is a conceptual diagram illustrating input image data of the driving controller of FIG. 1 when (N−1)-th frame data represents a grayscale value of 0, N-th frame data represents a grayscale value of 255, and (N+1)-th frame data represents a grayscale value of 255 according to an example embodiment.
Figure 8:
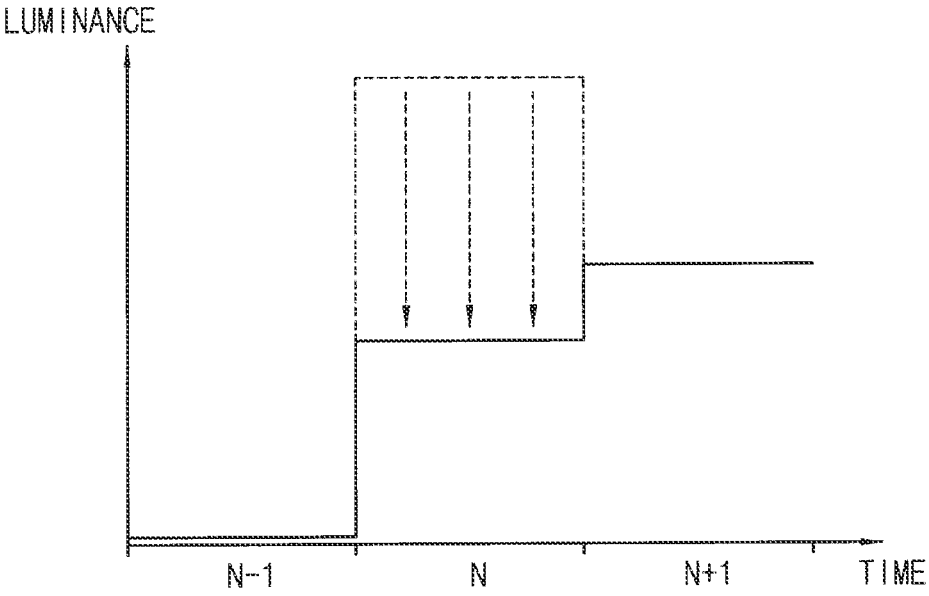
FIG. 8 is a graph illustrating luminance of a display panel of FIG. 1 according to the input image data of FIG. 7 according to an example embodiment.
Figure 9:
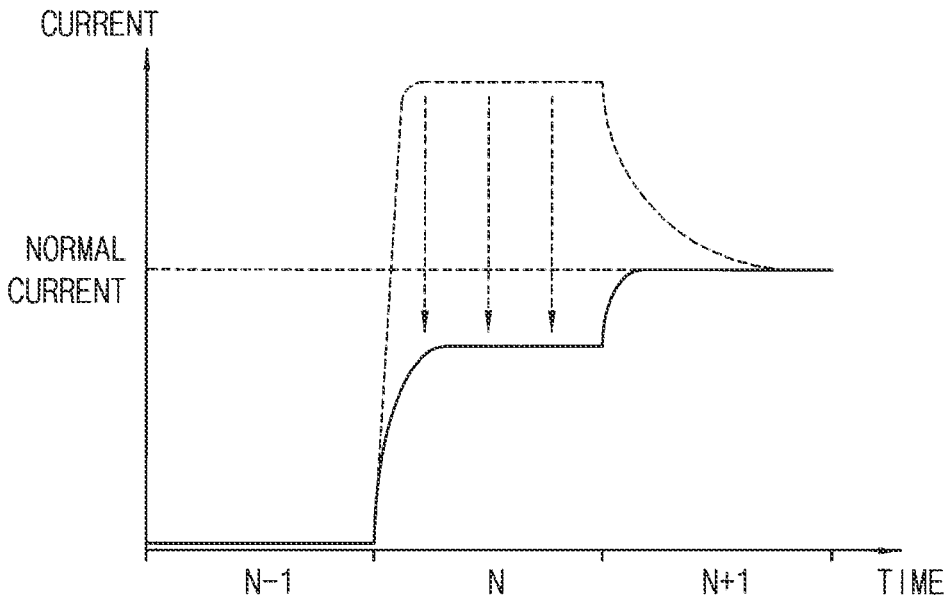
FIG. 9 is a graph illustrating a current of the display panel of FIG. 1 according to the input image data of FIG. 7 according to an example embodiment.

FIG. 7 is a conceptual diagram illustrating input image data of the driving controller 200 of FIG. 1 when (N−1)-th frame data IMG[N−1] represents a grayscale value of 0, N-th frame data IMG[N] represents a grayscale value of 255, and (N+1)-th frame data IMG[N+1] represents a grayscale value of 255. FIG. 8 is a graph illustrating luminance values of the display panel 100 of FIG. 1 according to the input image data IMG of FIG. 7. FIG. 9 is a graph illustrating quantities of a current of the display panel 100 of FIG. 1 according to the input image data IMG of FIG. 7.

Referring to FIGS. 1 to 9, if the (N−1)-th frame data IMG[N−1] represents the grayscale value of 0, the N-th frame data IMG[N] represents the grayscale value of 255, the (N+1)-th frame data IMG[N+1] represents the grayscale value of 255, and the driving controller 200 does not include the data clamper 240, the net power control setter 230 may not be operated in the N-th frame, due to the delay of one frame. Accordingly, luminance of a display image of the N-th frame is high and is shown in a dotted line in FIG. 8, and a current of the display panel 100 of the N-th frame may have an overcurrent which is out of a range of a normal current and is shown in a dotted line in FIG. 9.

In embodiments, the driving controller 200 includes the data clamper 240 so that the net power control setter 230 is not operated in the N-th frame (NPC OFF) but the data clamper 240 is operated in the N-th frame (DC ON). Thus, the luminance of the N-th frame may be decreased using the second scale factor SF[N] by the operation of the data clamper 240, as shown in FIG. 8. The current of the display panel 100 in the N-th frame may be decreased into the range of the normal current by the operation of the data clamper 240, as shown in FIG. 9.

Figure 10:
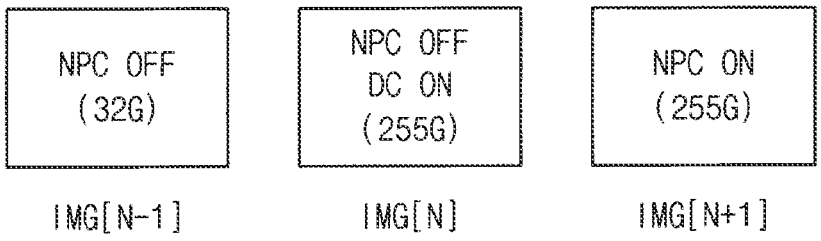
FIG. 10 is a conceptual diagram illustrating input image data of the driving controller of FIG. 1 when (N−1)-th frame data represents a grayscale value of 32, N-th frame data represents a grayscale value of 255, and (N+1)-th frame data represents a grayscale value of 255 according to an example embodiment.
Figure 11:
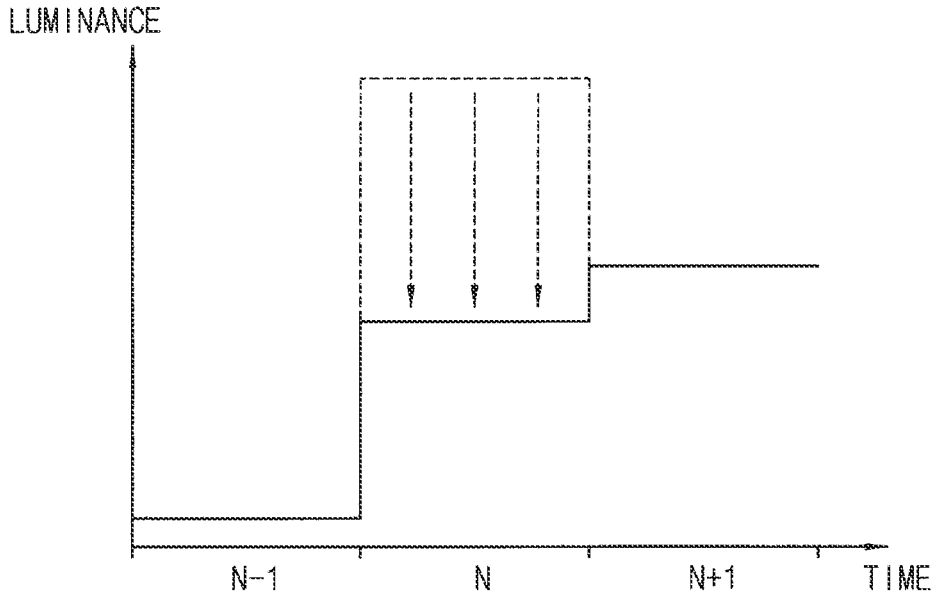
FIG. 11 is a graph illustrating luminance of the display panel of FIG. 1 according to the input image data of FIG. 10 according to an example embodiment.
Figure 12:
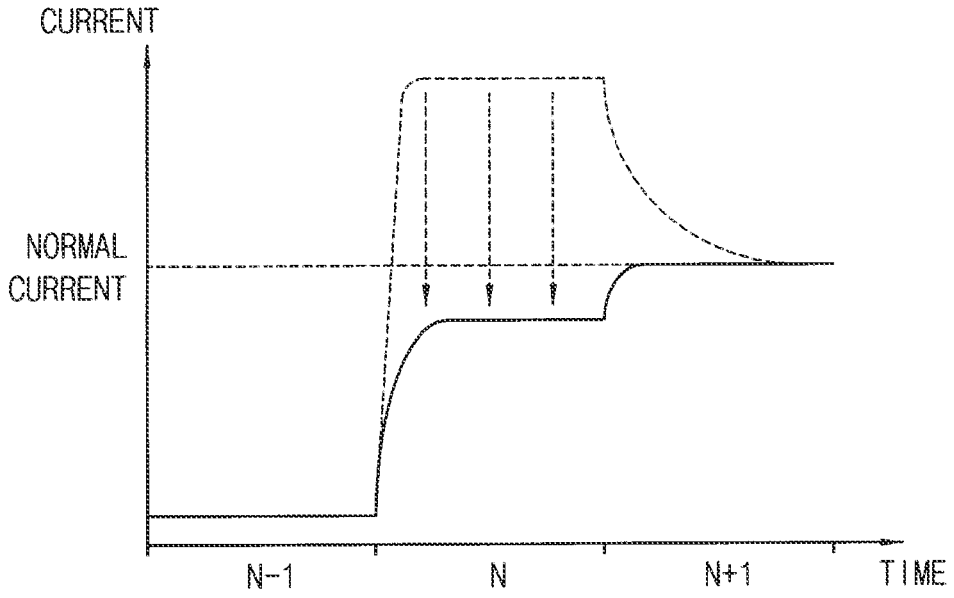
FIG. 12 is a graph illustrating a current of the display panel of FIG. 1 according to the input image data of FIG. 10 according to an example embodiment.

FIG. 10 is a conceptual diagram illustrating input image data of the driving controller 200 of FIG. 1 when (N−1)-th frame data IMG[N−1] represents a grayscale value of 32, N-th frame data IMG[N] represents a grayscale value of 255, and (N+1)-th frame data IMG[N+1] represent a grayscale value of 255. FIG. 11 is a graph illustrating luminance levels of the display panel 100 of FIG. 1 according to the input image data IMG of FIG. 10. FIG. 12 is a graph illustrating quantities of a current of the display panel 100 of FIG. 1 according to the input image data IMG of FIG. 10.

Referring to FIGS. 1 to 12, if the (N−1)-th frame data IMG[N−1] represent the grayscale value of 32, the N-th frame data IMG[N] represent the grayscale value of 255, the (N+1)-th frame data IMG[N+1] represent the grayscale value of 255, and the driving controller 200 does not include the data clamper 240, the net power control setter 230 may not be operated in the N-th frame, due to the delay of one frame. Accordingly, luminance of a display image of the N-th frame is high and is shown in a dotted line in FIG. 11, and a current of the display panel 100 of the N-th frame may have an overcurrent which is out of a range of a normal current and is shown in a dotted line in FIG. 12.

In embodiments, the driving controller 200 includes the data clamper 240 so that the net power control setter 230 is not operated in the N-th frame (NPC OFF) but the data clamper 240 is operated in the N-th frame (DC ON). Thus, the luminance of the N-th frame may be decreased using the second scale factor SF[N] by the operation of the data clamper 240, as shown in FIG. 11. The current of the display panel 100 in the N-th frame may be decreased into the range of the normal current by the operation of the data clamper 240, as shown in FIG. 12.

Figure 13:
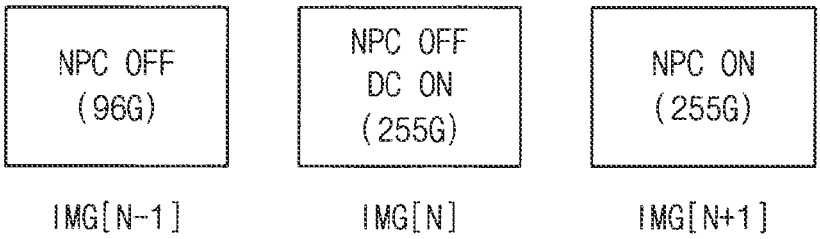
FIG. 13 is a conceptual diagram illustrating input image data of the driving controller of FIG. 1 when (N−1)-th frame data represents a grayscale value of 96, N-th frame data represents a grayscale value of 255, and (N+1)-th frame data represents a grayscale value of 255 according to an example embodiment.
Figure 14:
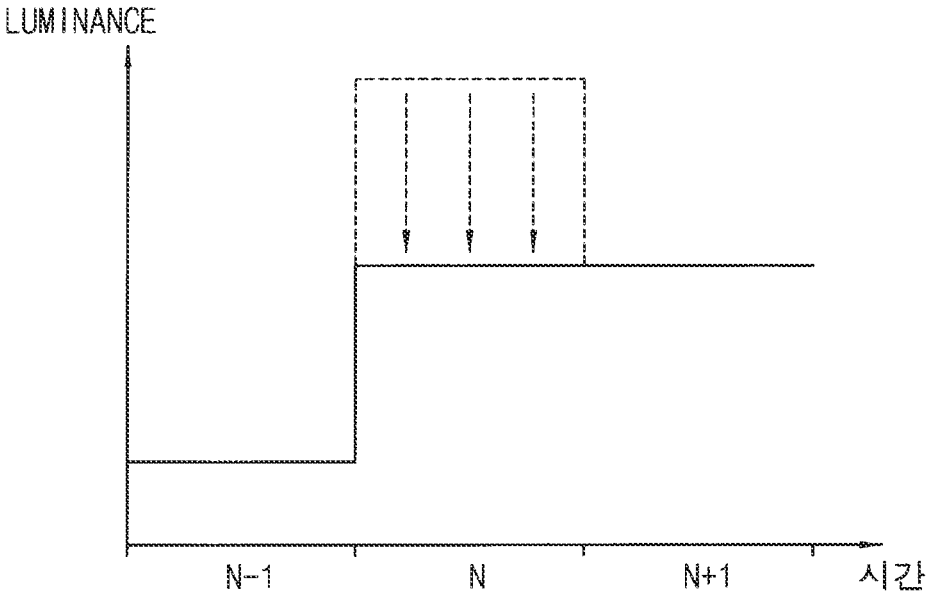
FIG. 14 is a graph illustrating luminance of the display panel of FIG. 1 according to the input image data of FIG. 13 according to an example embodiment.
Figure 15:
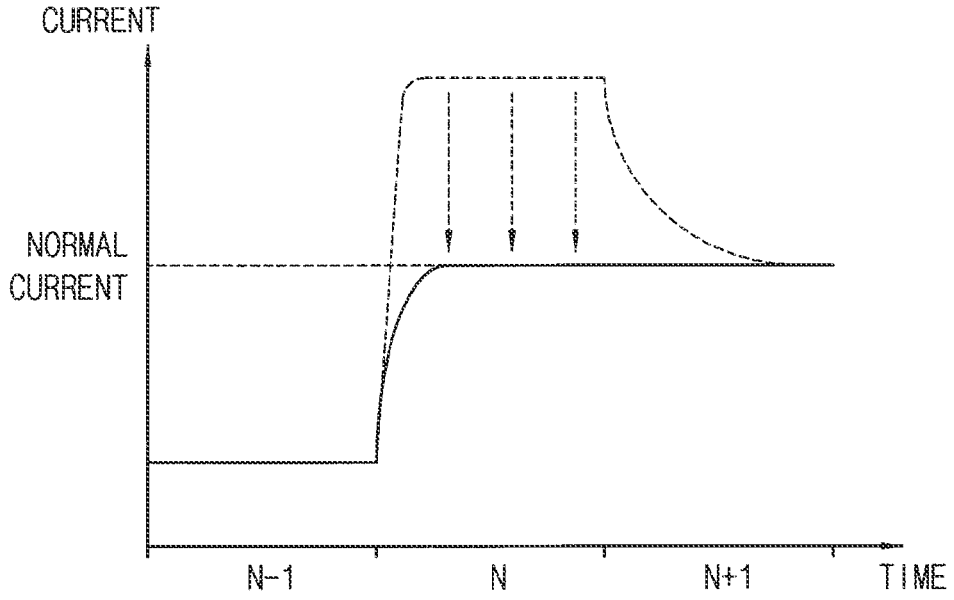
FIG. 15 is a graph illustrating a current of the display panel of FIG. 1 according to the input image data of FIG. 13 according to an example embodiment.

FIG. 13 is a conceptual diagram illustrating input image data of the driving controller 200 of FIG. 1 when (N−1)-th frame data IMG[N−1] represents a grayscale value of 96, N-th frame data IMG[N] represents a grayscale value of 255, and (N+1)-th frame data IMG[N+1] represents a grayscale value of 255. FIG. 14 is a graph illustrating luminance levels of the display panel 100 of FIG. 1 according to the input image data IMG of FIG. 10. FIG. 15 is a graph illustrating quantities of a current of the display panel 100 of FIG. 1 according to the input image data IMG of FIG. 10.

Referring to FIGS. 1 to 15, if the (N−1)-th frame data IMG[N−1] represents the grayscale value of 96, the N-th frame data IMG[N] represents the grayscale value of 255, the (N+1)-th frame data IMG[N+1] represents the grayscale value of 255, and the driving controller 200 does not include the data clamper 240, the net power control setter 230 may not be operated in the N-th frame, due to the delay of one frame. Accordingly, luminance of a display image of the N-th frame is high and is shown in a dotted line in FIG. 14, and a current of the display panel 100 of the N-th frame may have an overcurrent which is out of a range of a normal current and is shown in a dotted line in FIG. 15.

In embodiments, the driving controller 200 includes the data clamper 240 so that the net power control setter 230 is not operated in the N-th frame (NPC OFF) but the data clamper 240 is operated in the N-th frame (DC ON). Thus, the luminance of the N-th frame may be decreased using the second scale factor SF[N] by the operation of the data clamper 240, as shown in FIG. 14. The current of the display panel 100 in the N-th frame may be decreased into the range of the normal current by the operation of the data clamper 240, as shown in FIG. 15.

Figure 16:
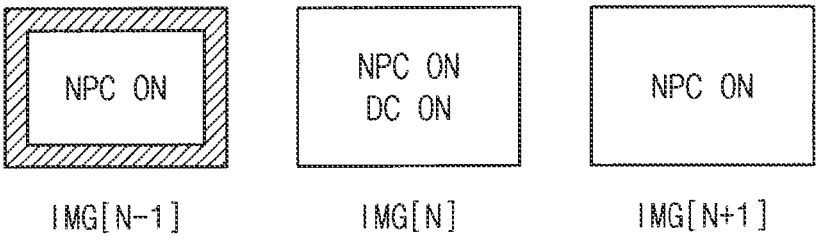
FIG. 16 is a conceptual diagram illustrating input image data of the driving controller of FIG. 1 when (N−1)-th frame data represents a load of 50%, N-th frame data represents a load of 100%, and (N+1)-th frame data represents a load of 100% according to an example embodiment.
Figure 17:
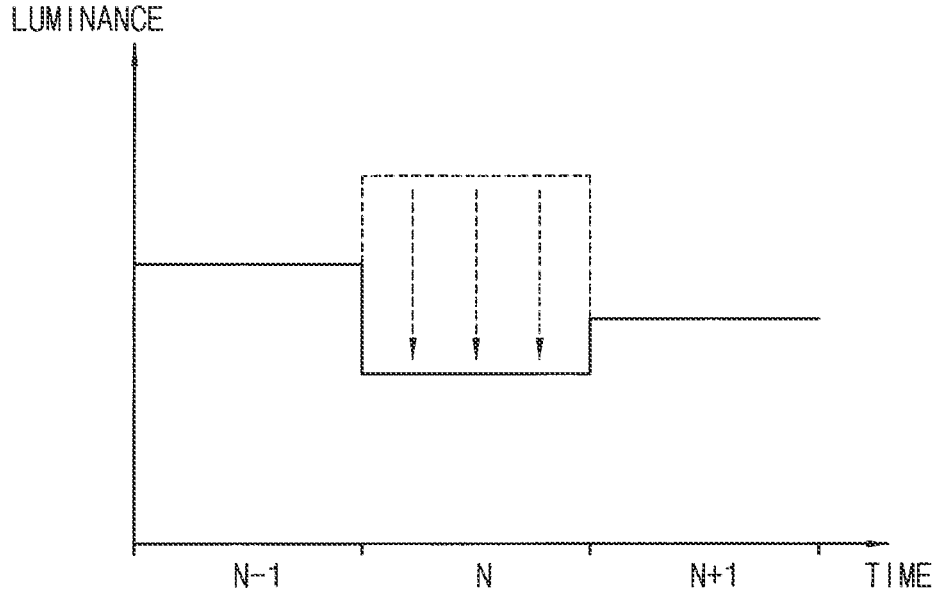
FIG. 17 is a graph illustrating luminance of the display panel of FIG. 1 according to the input image data of FIG. 16 according to an example embodiment.
Figure 18:
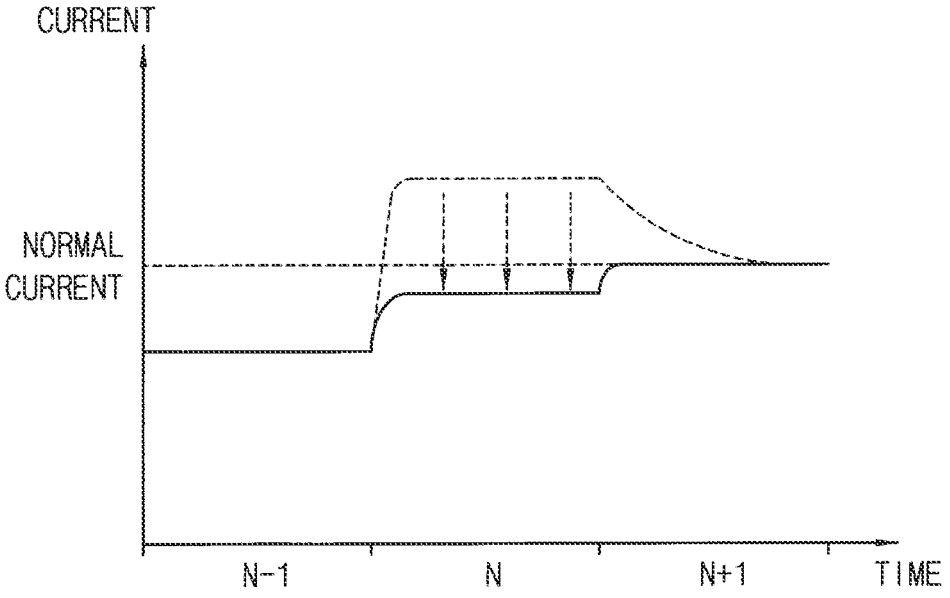
FIG. 18 is a graph illustrating a current of the display panel of FIG. 1 according to the input image data of FIG. 16 according to an example embodiment.

FIG. 16 is a conceptual diagram illustrating input image data IMG of the driving controller 200 of FIG. 1 when (N−1)-th frame data IMG[N−1] represents a load of 50%, N-th frame data IMG[N] represents a load of 100%, and (N+1)-th frame data IMG[N+1] represents a load of 100%. FIG. 17 is a graph illustrating luminance levels of the display panel 100 of FIG. 1 according to the input image data IMG of FIG. 16. FIG. 18 is a graph illustrating quantities of a current of the display panel 100 of FIG. 1 according to the input image data IMG of FIG. 16.

In FIGS. 16 to 18, the (N−1)-th frame data IMG[N−1] represents the load of 50%, the N-th frame data IMG[N] represents the load of 100%, and the (N+1)-th frame data IMG[N+1] represents the load of 100%.

In the (N−1)-th frame, the net power control setter 230 may be operated, due to the load of 50%. However, the scale factor for the load of 50% may not be sufficient to prevent the overcurrent of the input image data having the load of 100%.

If the (N−1)-th frame data represents the load of 50%, the N-th frame data represents the load of 100%, the (N+1)-th frame data represents the load of 100%, and the driving controller 200 does not include the data clamper 240, the net power control setter 230 may be operated (NPC ON) in the N-th frame but the scale factor may be for the load of 50%, due to the delay of one frame. Accordingly, luminance of a display image of the N-th frame is high and is shown in a dotted line in FIG. 17, and a current of the display panel 100 of the N-th frame may have an overcurrent which is out of a range of a normal current and is shown in a dotted line in FIG. 18.

In embodiments, the driving controller 200 includes the data clamper 240 so that the data clamper 240 is operated in the N-th frame (DC ON). Thus, the luminance of the N-th frame may be decreased using the second scale factor SF[N] by the operation of the data clamper 240, as shown in FIG. 17. The current of the display panel 100 in the N-th frame may be decreased into the range of the normal current by the operation of the data clamper 240, as shown in FIG. 18.

According to embodiments, the luminance of the display panel 100 may be adjusted according to the load of the input image data IMG so that a potential overcurrent flowing through the data driver 500 or the display panel 100 may be prevented.

The driving controller 200 includes the data clamper 240 determining the second scale factor SF[N] of the N-th frame based on the load of the (N−1)-th frame data so as to prevent the overcurrent flowing through the data driver 500 or the display panel 100 during the N-th frame potentially caused by the delay of one frame for determining the load of the input image data IMG and the scale factor. Thus, damage to the data driver 500 or the display panel 100 may be prevented, so that the reliability of the display apparatus may be satisfactory.

Figure 19:
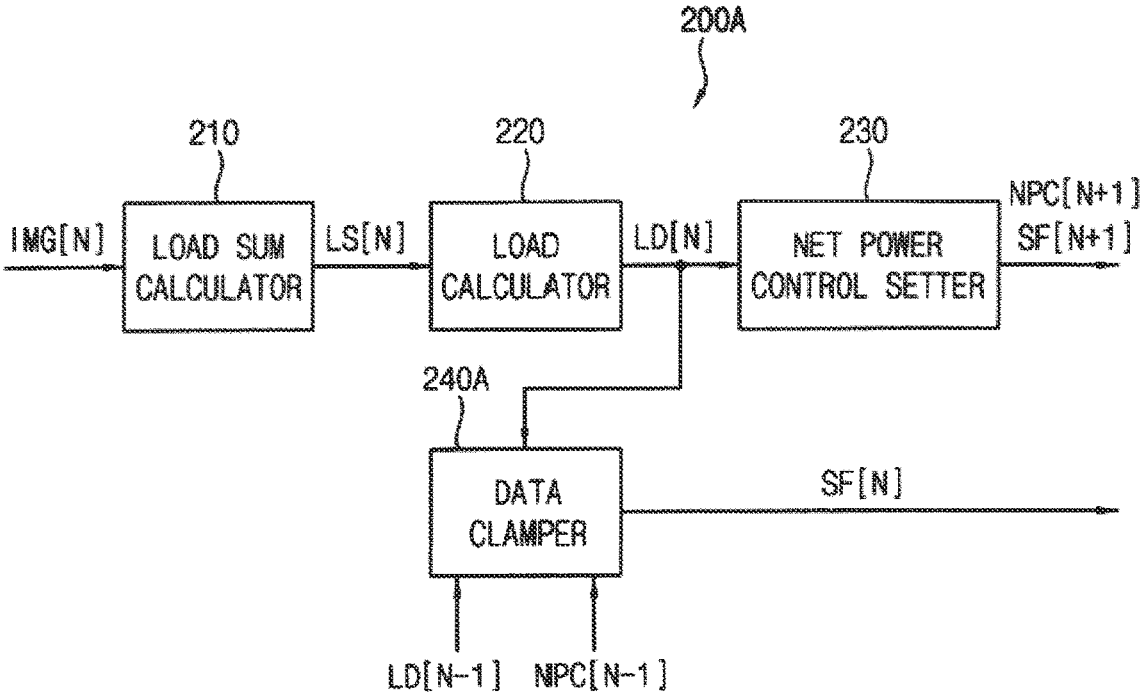
FIG. 19 is a block diagram illustrating a driving controller of a display apparatus according to an example embodiment.

FIG. 19 is a block diagram illustrating a driving controller 200A of a display apparatus according to an example embodiment.

The driving controller, the display apparatus and the method of driving the display panel associated with FIG. 19 may be substantially the same as or analogous to the driving controller, the display apparatus and the method of driving the display panel explained referring to FIGS. 1 to 18 except for the structure and the operation of the driving controller.

Referring to FIGS. 1 and 3 to 19, the display apparatus includes a display panel 100 and a display panel driver. The display panel driver includes a driving controller 200A, a gate driver 300, a gamma reference voltage generator 400 and a data driver 500.

The driving controller 200A includes a load sum calculator 210, a load calculator 220, a net power control setter 230 and a data clamper 240A.

The load sum calculator 210 may receive N-th frame data IMG[N] and calculate a sum LS[N] of total grayscale values of the N-th frame data IMG[N].

The load calculator 220 may receive the sum LS[N] of the total grayscale values of the N-th frame data IMG[N] and calculate a load LD[N] of the N-th frame data IMG[N].

The net power control setter 230 may determine a first scale factor SF[N+1] for adjusting a grayscale value of (N+1)-th frame data based on the load LD[N] of the N-th frame data IMG[N] and a net power control reference value.

The data clamper 240A may determine a second scale factor SF[N] for adjusting a grayscale value of the N-th frame data IMG[N] based on the load LD[N−1] of (N−1)-th frame data and the load LD[N] of N-th frame data. The data clamper 240A may directly receive the load LD[N] of the N-th frame data from the load calculator 220.

The data clamper 240A may be activated when the (N−1)-th frame data is different from the N-th frame data IMG[N]. The data clamper 240A may be inactivated when the (N−1)-th frame data is same as the N-th frame data IMG[N]. The data clamper 240A may compare the load LD[N−1] of the (N−1)-th frame data and the load LD[N] of the N-th frame data to determine the activation of the data clamper 240A.

According to embodiments, the luminance of the display panel 100 may be adjusted according to the load of the input image data IMG so that a potential overcurrent flowing through the data driver 500 or the display panel 100 may be prevented.

The driving controller 200 includes the data clamper 240A determining the second scale factor SF[N] of the N-th frame based on the load of the (N−1)-th frame data so as to prevent a overcurrent flowing through the data driver 500 or the display panel 100 during the N-th frame potentially caused by the delay of one frame for determining the load of the input image data IMG and the scale factor. Thus, damage to the data driver 500 or the display panel 100 may be prevented, so that the reliability of the display apparatus may be satisfactory.

Figure 20:
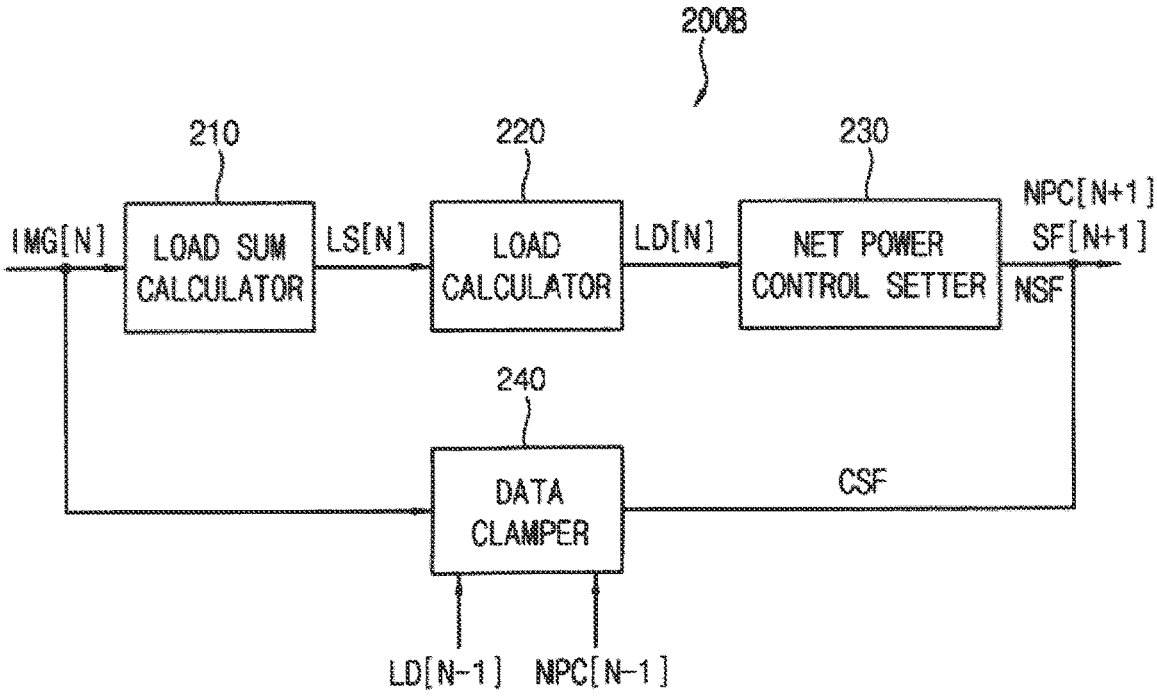
FIG. 20 is a block diagram illustrating a driving controller of a display apparatus according to an example embodiment.

FIG. 20 is a block diagram illustrating a driving controller 200B of a display apparatus according to an example embodiment.

The driving controller, the display apparatus and the method of driving the display panel associated with FIG. 20 may be substantially the same as or analogous to the driving controller, the display apparatus and the method of driving the display panel explained referring to FIGS. 1 to 18 except for the structure and the operation of the driving controller.

Referring to FIGS. 1, 3 to 18 and 20, the display apparatus includes a display panel 100 and a display panel driver. The display panel driver includes a driving controller 200B, a gate driver 300, a gamma reference voltage generator 400 and a data driver 500.

The driving controller 200B includes a load sum calculator 210, a load calculator 220, a net power control setter 230 and a data clamper 240.

The load sum calculator 210 may receive N-th frame data IMG[N] and calculate a sum LS [N] of total grayscale values of the N-th frame data IMG[N].

The load calculator 220 may receive the sum LS[N] of the total grayscale values of the N-th frame data IMG[N] and calculate a load LD[N] of the N-th frame data IMG[N].

The net power control setter 230 may determine a first scale factor SF[N+1] for adjusting a grayscale value of (N+1)-th frame data based on the load LD[N] of the N-th frame data IMG[N] and a net power control reference value.

The data clamper 240 may determine a second scale factor SF[N] for adjusting a grayscale value of the N-th frame data IMG[N] based on the load LD[N−1] of (N−1)-th frame data and the N-th frame data IMG[N].

The driving controller 200B may determine a final scale factor SF[N+1] of the (N+1)-th frame data by multiplying the first scale factor NSF and the second scale factor CSF. The second scale factor CSF may be determined for reducing the level of the first scale factor NSF. When the second scale factor CSF is 1, the data clamper 240B may be deactivated.

According embodiments, the luminance of the display panel 100 may be adjusted according to the load of the input image data IMG, so that a potential overcurrent flowing through the data driver 500 or the display panel 100 may be prevented.

The driving controller 200 includes the data clamper 240A determining the second scale factor CSF of the N-th frame based on the load of the (N−1)-th frame data so as to prevent a overcurrent flowing through the data driver 500 or the display panel 100 during the N-th frame potentially caused by the delay of one frame for determining the load of the input image data IMG and the scale factor. Thus, damage to the data driver 500 or the display panel 100 may be prevented, so that the reliability of the display apparatus may be satisfactory.

The foregoing is illustrative and is not to be construed as limiting. Many modifications are possible in the described example embodiments. All such modifications are intended to be included within the scope defined in the claims. In the claims, means-plus-function clauses are intended to cover the structures described herein as performing the recited function and not only structural equivalents but also equivalent structures.

What is claimed is:

1. A driving controller set comprising:

a driving controller configured to determine a first scale factor for adjusting a grayscale value of (N+1)-th frame data based on a load of N-th frame data and a net power control reference value, configured to compare at least one value related to (N−1)-th fame data with at least one value related to the N-th frame data for determining whether to determine a second scale factor, and configured to determine the second scale factor for adjusting a grayscale value of the N-th frame data based on a load of the (N−1)-th frame data and the N-th frame data, wherein N is an integer equal to or greater than two, and wherein a data signal is generated using at least one of the first scale factor and the second scale factor;

a data line formed of at least one conductive material; and a data driver electrically connected to the driving controller, and the data line, configured to use the data signal to generate a data voltage, and configured to output the data voltage to the data line.

2. The driving controller set of claim 1, wherein the driving controller comprises a data clamper configured to determine the second scale factor, wherein the data clamper is activated when the (N−1)-th frame data is different from the N-th frame data, and wherein the data clamper is deactivated when the (N−1)-th frame data is same as the N-th frame data.

3. The driving controller set of claim 1, wherein the driving controller comprises a data clamper configured to determine the second scale factor, wherein the data clamper is configured to receive the load of the (N−1)-th frame data, a net power control signal of an (N−1)-th frame, and the N-th frame data.

4. The driving controller set of claim 3, wherein when the net power control signal of the (N−1)-th frame is inactive, the second scale factor gradually decreases as the load of the (N−1)-th frame data increases from 0% to the net power control reference value.

5. The driving controller set of claim 4, wherein when the net power control signal of the (N−1)-th frame is active, the second scale factor gradually decreases as the load of the (N−1)-th frame data increases from the net power control reference value to 100%.

6. The driving controller set of claim 1, wherein when the net power control signal of the (N−1)-th frame is inactive, the second scale factor is fixed regardless of the load of the (N−1)-th frame data.

7. The driving controller set of claim 6, wherein when the net power control signal of the (N−1)-th frame is active, the second scale factor is fixed regardless of the load of the (N−1)-th frame data.

8. The driving controller set of claim 1, wherein the driving controller comprises a load sum calculator configured to receive the N-th frame data and to calculate a sum of total grayscale values of the N-th frame data.

9. The driving controller set of claim 8, wherein the driving controller further comprises a load calculator configured to receive the sum of the total grayscale values of the N-th frame data and to calculate the load of the N-th frame data.

10. The driving controller set of claim 9, wherein the driving controller further comprises a data clamper configured to determine the second scale factor, wherein the data clamper is configured to receive the load of the N-th frame data from the load calculator.

11. The driving controller set of claim 1, wherein a final scale factor of the (N+1)-th frame data is determined by multiplying the first scale factor and the second scale factor.

12. A display apparatus comprising:

a display panel comprising a data line and a pixel electrically connected to the data line, wherein the data line is formed of at least one conductive material;

a driving controller configured to determine a first scale factor for adjusting a grayscale value of (N+1)-th frame data based on a load of N-th frame data and a net power control reference value, configured to compare at least one value related to (N−1)-th frame data with at least one value related to the N-th frame data for determining whether to determine a second scale factor, and configured to determine the second scale factor for adjusting a grayscale value of the N-th frame data based on a load of the (N−1)-th frame data and the N-th frame data, wherein N is an integer equal to or greater than two, and wherein the driving controller is configured to generate a data signal based on at least one of the first scale factor and the second scale factor; and a data driver electrically connected to each of the driving controller and the display panel, configured to use the data signal to generate a data voltage, and configured to output the data voltage through the data line to the pixel to control luminance of the pixel.

13. The display apparatus of claim 12, wherein the driving controller comprises a data clamper configured to determine the second scale factor, wherein the data clamper is activated when the (N−1)-th frame data is different from the N-th frame data, and wherein the data clamper is deactivated when the (N−1)-th frame data is same as the N-th frame data.

14. The display apparatus of claim 12, wherein the driving controller comprises a data clamper configured to determine the second scale factor, wherein the data clamper is configured to receive the load of the (N−1)-th frame data, a net power control signal of an (N−1)-th frame, and the N-th frame data.

15. The display apparatus of claim 12, wherein the driving controller comprises a load sum calculator configured to receive the N-th frame data and to calculate a sum of total grayscale values of the N-th frame data.

16. The display apparatus of claim 15, wherein the driving controller further comprises a load calculator configured to receive the sum of the total grayscale values of the N-th frame data and to calculate the load of the N-th frame data.

17. The display apparatus of claim 16, wherein the driving controller further comprises a data clamper configured to determine the second scale factor, wherein the data clamper is configured to receive the load of the N-th frame data from the load calculator.

18. A method of driving a display panel, the method comprising:

determining a first scale factor for adjusting a grayscale value of (N+1)-th frame data based on a load of N-th frame data and a net power control reference value;

comparing at least one value related to (N−1)-th frame data with at least one value related to the N-th frame data for determining whether to determine a second scale factor;

determining the second scale factor for adjusting a grayscale value of the N-th frame data based on a load of the (N−1)-th frame data and the N-th frame data; and controlling luminance of a pixel of the display panel using at least one of the first scale factor and the second scale factor, wherein N is an integer equal to or greater than two.

19. The method of claim 18, wherein the second scale factor is generated when the (N−1)-th frame data is different from the N-th frame data, and wherein the second scale factor is not generated when the (N−1)-th frame data is same as the N-th frame data.

20. The method of claim 18, further comprising determining a final scale factor of the (N+1)-th frame data by multiplying the first scale factor and the second scale factor.

* * * * *